US009157186B2

(12) United States Patent
Jo et al.

(10) Patent No.: US 9,157,186 B2
(45) Date of Patent: Oct. 13, 2015

(54) DEVICE OF MOVING LOW IGNITION PROPENSITY CIGARETTE PAPER AND DEVICE OF MANUFACTURING LOW IGNITION PROPENSITY CIGARETTE PAPER INCLUDING THE SAME

(75) Inventors: Young-Il Jo, Daejeon (KR); Harg-Jo Kwon, Daejeon (KR); Jung-Yeon Park, Daejeon (KR); Jong-Oh Kim, Daejeon (KR); Sun-Cheol Kwon, Daejeon (KR)

(73) Assignee: KT & CORPORATION, Daejeon (KR)

( * ) Notice: Subject to any disclaimer, the term of this patent is extended or adjusted under 35 U.S.C. 154(b) by 0 days.

(21) Appl. No.: 14/356,872

(22) PCT Filed: Jun. 29, 2012

(86) PCT No.: PCT/KR2012/005168

§ 371 (c)(1),
(2), (4) Date: May 7, 2014

(87) PCT Pub. No.: WO2013/069868

PCT Pub. Date: May 16, 2013

(65) Prior Publication Data

US 2014/0352906 A1 Dec. 4, 2014

(30) Foreign Application Priority Data

Nov. 8, 2011 (KR) ..... 10-2011-0116086

(51) Int. Cl.

| | |
|---|---|
| ***D21F 9/00*** | (2006.01) |
| ***A24D 1/02*** | (2006.01) |
| ***A24C 5/00*** | (2006.01) |
| ***B65H 20/14*** | (2006.01) |

(52) U.S. Cl.

CPC . *D21F 9/00* (2013.01); *A24C 5/005* (2013.01); *A24D 1/025* (2013.01); *B65H 20/14* (2013.01); *B65H 2301/517* (2013.01); *B65H 2406/111* (2013.01); *B65H 2701/194* (2013.01); *B65H 2801/54* (2013.01)

(58) Field of Classification Search

CPC ..... A24D 1/025; A24C 4/005; B65H 20/14; B65H 2301/517; B65H 2406/111; B65H 2701/194; B65H 2801/54; D21F 9/00

USPC ..... 162/139, 265; 131/284, 365, 373–374; 226/37.1, 97.3

See application file for complete search history.

(56) References Cited

U.S. PATENT DOCUMENTS

| | | | | | |
|---|---|---|---|---|---|
| 4,848,633 | A | * | 7/1989 | Hagen et al. | 226/97.3 |
| 4,874,000 | A | * | 10/1989 | Tamol et al. | 131/375 |
| 5,199,623 | A | * | 4/1993 | Rajala et al. | 242/615.12 |
| 5,595,196 | A | | 1/1997 | Salonen et al. | |

(Continued)

FOREIGN PATENT DOCUMENTS

| | | | |
|---|---|---|---|
| CA | 2126494 C | * | 6/2003 |
| CN | 1213274 A | | 4/1999 |

(Continued)

*Primary Examiner* — Jose Fortuna

(74) *Attorney, Agent, or Firm* — McDermott Will & Emery LLP

(57) ABSTRACT

An exemplary embodiment provides a device of moving a low ignition propensity cigarette paper which includes an air moving body portion having a curved surface, an inlet injecting air, and a plurality of outlets disposed at the curved surface to discharge the air, in which the low ignition propensity cigarette paper having a coating portion is floated and turned by the air discharged from the plurality of outlets.

4 Claims, 3 Drawing Sheets

(56) References Cited

U.S. PATENT DOCUMENTS

| | | | | |
|---|---|---|---|---|
| 5,820,998 | A * | 10/1998 | Hotaling et al. | 428/533 |
| 5,997,691 | A * | 12/1999 | Gautam et al. | 162/134 |
| 6,004,432 | A * | 12/1999 | Page et al. | 162/281 |
| 6,454,903 | B2 * | 9/2002 | Mohrsen et al. | 162/193 |
| 6,635,111 | B1 * | 10/2003 | Holtmann et al. | 118/325 |
| 6,705,220 | B2 * | 3/2004 | Boucher | 101/228 |
| 6,725,867 | B2 * | 4/2004 | Peterson et al. | 131/365 |
| 7,311,234 | B2 * | 12/2007 | Solberg | 226/97.3 |
| 7,727,582 | B2 * | 6/2010 | Sakamoto | 427/162 |
| 8,397,539 | B2 * | 3/2013 | Chang et al. | 65/245 |
| 8,632,156 | B2 * | 1/2014 | Korogi et al. | 347/16 |
| 8,858,760 | B2 * | 10/2014 | Kida et al. | 162/232 |
| 8,863,657 | B2 * | 10/2014 | Burger | 101/35 |
| 8,869,805 | B2 * | 10/2014 | Wanna | 131/365 |
| 2002/0020419 | A1 | 2/2002 | Maiwald et al. | |
| 2003/0075293 | A1 * | 4/2003 | Moeller et al. | 162/193 |
| 2006/0288601 | A1 * | 12/2006 | Mayer et al. | 34/71 |
| 2007/0029060 | A1 * | 2/2007 | Murray et al. | 162/134 |
| 2011/0132382 | A1 * | 6/2011 | Kim et al. | 131/365 |
| 2014/0101960 | A1 * | 4/2014 | Kida et al. | 34/60 |
| 2014/0102465 | A1 * | 4/2014 | Snow et al. | 131/351 |
| 2014/0261503 | A1 * | 9/2014 | Kim et al. | 131/332 |
| 2014/0305370 | A1 * | 10/2014 | Jo et al. | 118/68 |
| 2014/0352906 | A1 * | 12/2014 | Jo et al. | 162/265 |
| 2015/0004321 | A1 * | 1/2015 | Burger | 427/379 |

FOREIGN PATENT DOCUMENTS

| | | | |
|---|---|---|---|
| CN | 1328791 | A | 1/2002 |
| EP | 0658506 | A1 | 6/1995 |
| EP | 671505 | A2 * | 9/1995 |
| JP | 2000-505311 | A | 5/2000 |
| KR | 10-2005-0003906 | A | 1/2005 |
| WO | WO-2010/124879 | A1 | 11/2010 |

* cited by examiner

DEVICE OF MOVING LOW IGNITION PROPENSITY CIGARETTE PAPER AND DEVICE OF MANUFACTURING LOW IGNITION PROPENSITY CIGARETTE PAPER INCLUDING THE SAME

TECHNICAL FIELD

A device of moving a low ignition propensity cigarette paper and a device of manufacturing a low ignition propensity cigarette paper including the same are provided.

BACKGROUND ART

In general, various kinds of leaf tobaccos are mixed and processed to obtain desired smell and taste in order to manufacture cigarettes. Next, cut tobacco leaves or shredded tobaccos are produced by cutting the processed leaf tobaccos and a cigarette without a filter is produced by wrapping the cut tobacco leaves with a cigarette paper. Next, a filter may be attached to the non-filter cigarette.

A cigarette filter may contain active carbon and a flavor material. A cigarette filter may be formed in a mono-filter or a multi-filter and is wrapped with a cigarette filter-wrapping paper. The cut tobacco leaves and the tobacco filter are connected by a tipping paper and the tipping paper may have fine holes.

The cigarette paper may be manufactured not only to achieve target tar and target nicotine in smoking by appropriate porosity and combustibility, but to be provided with the peculiar smoke flavor of the cigarette. The cigarette paper may be made of flax or wood pulp.

A low ignition propensity cigarette paper is coated with a substance such as starch in a band shape and the porosity of the coating portion is low, so that when the combustion of the tobacco reaches the band portion, the amount of oxygen flowing into the cut tobacco leaves reduces and the cigarette may be put out.

When the coated low ignition propensity cigarette paper is moved, the coated surface may be damaged and poor moving may be generated.

The above information disclosed in this Background section is only for enhancement of understanding of the background of the invention and therefore it may contain information that does not form the prior art that is already known in this country to a person of ordinary skill in the art.

DISCLOSURE OF INVENTION

Technical Problem

An embodiment may reduce damages to a coated surface of the low ignition propensity cigarette paper.

An embodiment may reduce poor moving of the low ignition propensity cigarette paper.

The present invention may be used to achieve other aspects that are not stated in detail, other than the objects described above.

Solution to Problem

An exemplary embodiment provides a device of moving a low ignition propensity cigarette paper which includes an air moving body portion having a curved surface, an inlet injecting air, and a plurality of outlets disposed at the curved surface to discharge the air, in which the low ignition propensity cigarette paper having a coating portion is floated and turned by the air discharged from the plurality of outlets.

The air moving unit may further include a side guide member that guides a side of the low ignition propensity cigarette paper.

Angle q degrees of the air moving body portion may be about p−10 degrees to about p+10 degrees and p may be a turning angle of the low ignition propensity cigarette paper.

An exemplary embodiment provides a device of manufacturing a low ignition propensity cigarette paper, which includes a coating unit that discharges a low ignition propensity cigarette paper having a coated portion by coating a cigarette paper with a coating composition, a drying unit that dries the low ignition propensity cigarette paper, an air moving unit that floats and turns the low ignition propensity cigarette paper by air; and a cooling unit that cools the low ignition propensity cigarette paper.

The air moving unit may have an air moving body portion having a curved surface, an inlet injecting air, and a plurality of outlet disposed at the curved surface to discharge the air.

The air moving unit may further include a side guide member that guides a side of the low ignition propensity cigarette paper.

Advantageous Effects of Invention

An exemplary embodiment may reduce damages to a coated surface of the low ignition propensity cigarette paper and may decrease poor moving of the low ignition propensity cigarette paper.

MODE FOR THE INVENTION

Figure 1:
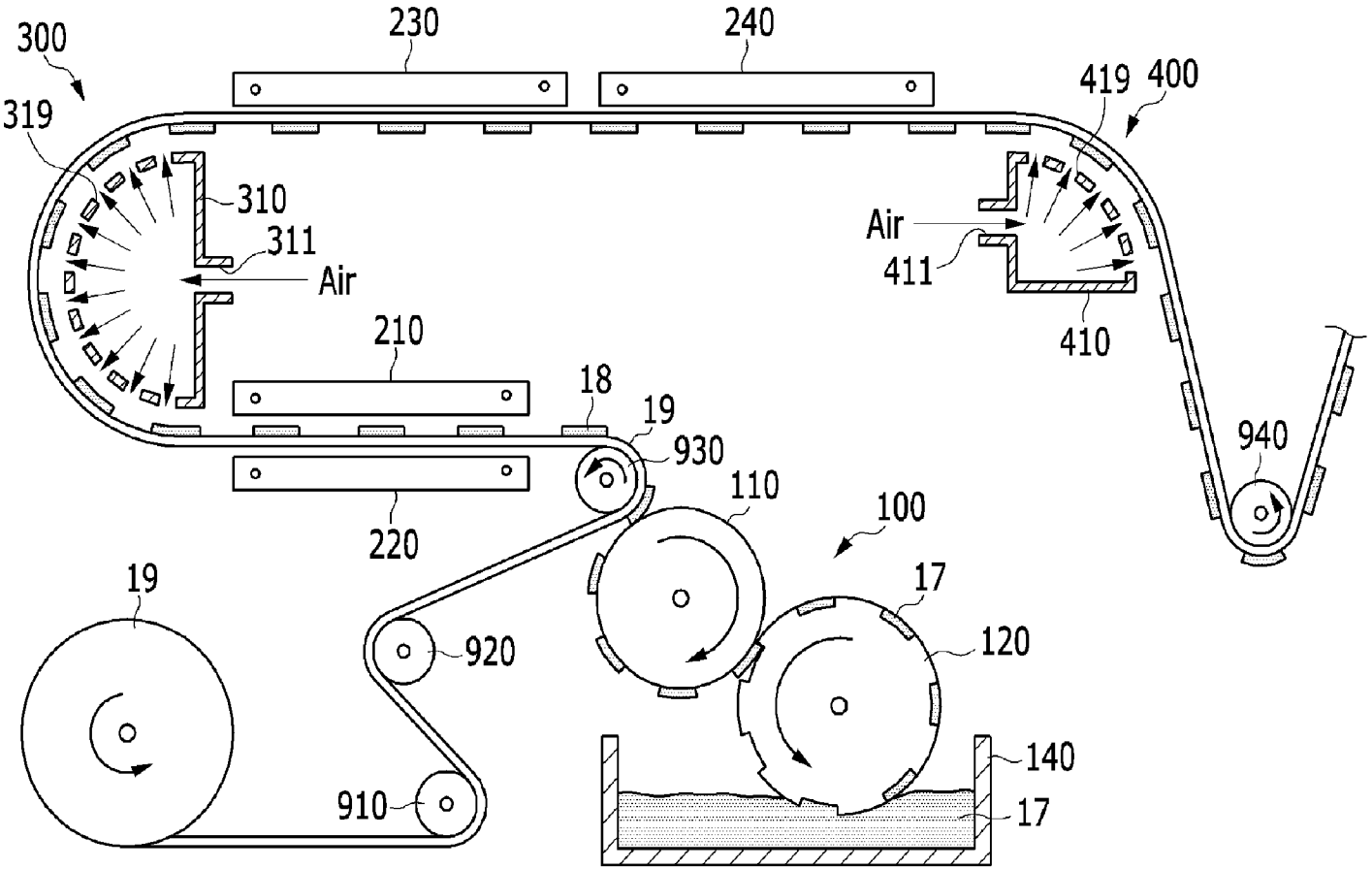
FIG. 1 is a cross-sectional view schematically showing a device of manufacturing a low ignition propensity cigarette paper according to an exemplary embodiment.

The present invention will be described more fully with reference to the accompanying drawings, in which exemplary embodiments of the invention are shown. As those skilled in the art would realize, the described embodiments may be modified in various different ways, all without departing from the spirit or scope of the present invention. In the accompanying drawings, portions unrelated to the description will be omitted in order to obviously describe the present invention, and like reference numerals will be used to describe like components throughout the present specification. Further, detailed descriptions of well-known technologies are not provided.

Hereinafter, a device of moving a low ignition propensity cigarette paper and a device of manufacturing a low ignition propensity cigarette paper according to an exemplary embodiment will be described in detail with reference to FIGS. 1 to 6.

Figure 2:
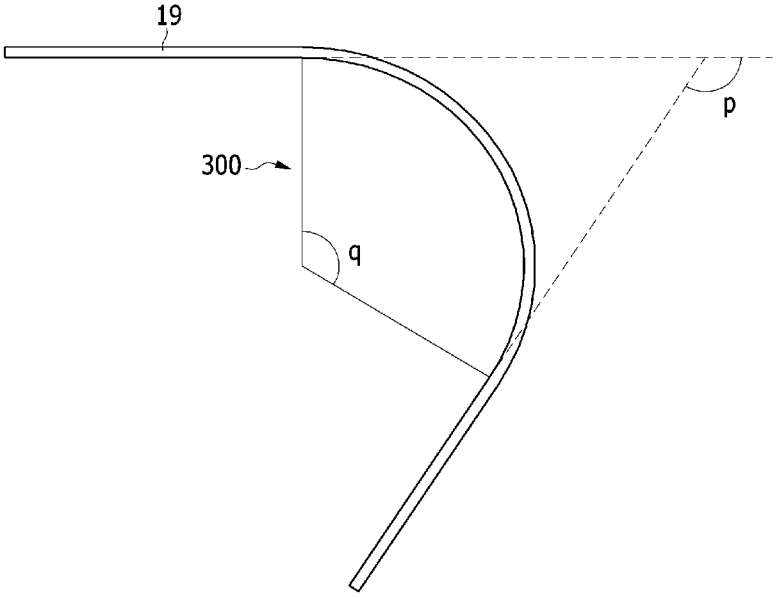
FIG. 2 is a cross-sectional view schematically showing a moving device according to an exemplary embodiment.
Figure 3:
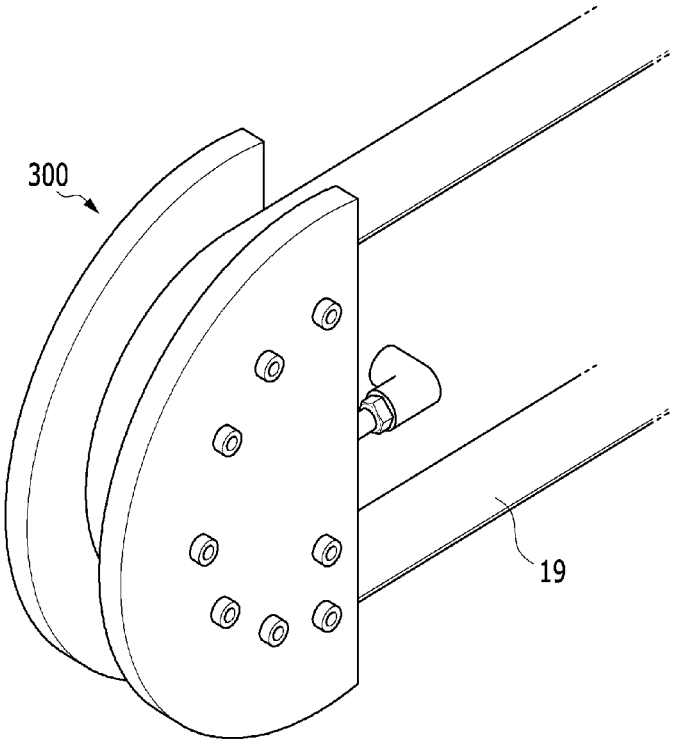
FIG. 3 is a perspective view schematically showing a moving device according to an exemplary embodiment.
Figure 4:
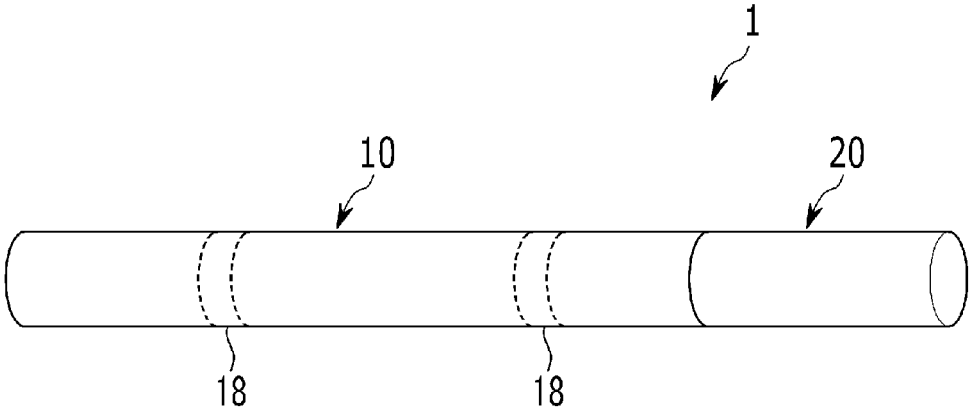
FIG. 4 is a perspective view schematically showing a cigarette including a low ignition propensity cigarette paper.
Figure 5:
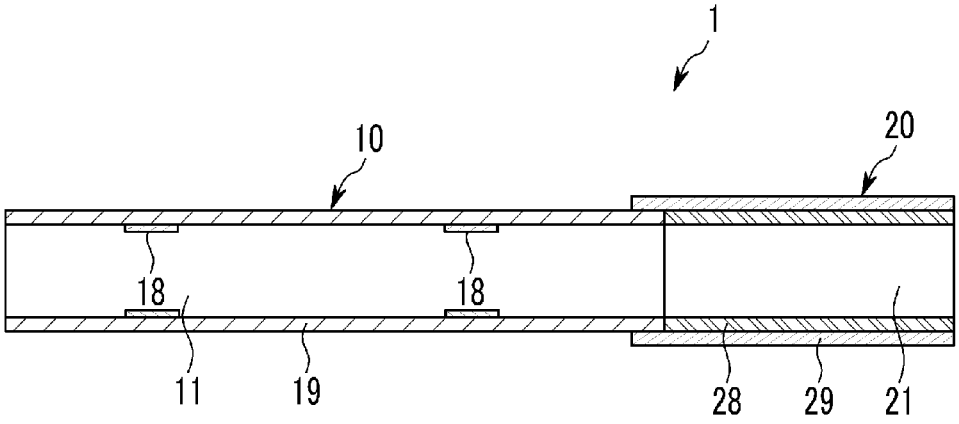
FIG. 5 is a cross-sectional view schematically showing a cigarette including a low ignition propensity cigarette paper.
Figure 6:
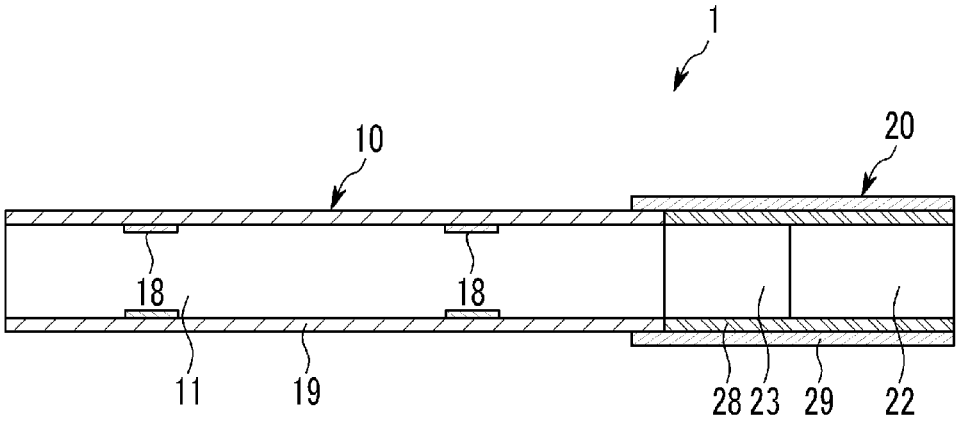
FIG. 6 is a cross-sectional view schematically showing a cigarette including a low ignition propensity cigarette paper.

FIG. 1 is a cross-sectional view schematically showing a device of manufacturing a low ignition propensity cigarette paper according to an exemplary embodiment, FIG. 2 is a cross-sectional view schematically showing a moving device according to an exemplary embodiment, FIG. 3 is a perspective view schematically showing a moving device according to an exemplary embodiment, FIG. 4 is a perspective view schematically showing a cigarette including a low ignition propensity cigarette paper, FIG. 5 is a cross-sectional view schematically showing a cigarette including a low ignition propensity cigarette paper, and FIG. 6 is a cross-sectional view schematically showing a cigarette including a low ignition propensity cigarette paper.

Referring to FIG. 1, a roll of cigarette paper 19 is supplied to a coating unit 100 through rollers 910, 920, and 930.

The coating unit 100 is a unit that coats a coating composition 17 on the cigarette paper 19. For example, the coating unit 100 may include a flat roller 110 and a concave roller 120. As the concave roller 120 rotates, the coating composition 17 is transmitted to the flat roller 110 and then applied onto the cigarette paper 19 by the flat roller 110, and the low ignition propensity cigarette paper 19 coated with the coating composition 17 is moved through the roller 930. The coating unit 100 may include a supplying member 140 filled with the coating composition 17. Referring to FIG. 1, the supplying member 140 may supply the coating composition 17 to a lower portion of the concave roller 120. Further, the supplying member 140 may supply the coating composition 17 to an upper portion where the concave roller 120 and the flat roller 110 meet each other.

The low ignition propensity cigarette paper 19 coated with the coating composition 17 through the coating unit 100 passes drying units 210 and 220 that dry the coating portions 18. For example, the drying units 210 and 220 may be heating bars, near-infrared lamps, and the like. One or more drying units may be used.

The low ignition propensity cigarette paper 19 that have passed the drying units 210 and 220 passes an air moving unit 300. The air moving unit 300 has an air inlet 311 through which air is injected, outlets 319 through which air is ejected, and an air moving body portion 310. The air moving unit 300 may reduce damages to the coating portions 18 of the low ignition propensity cigarette paper 19 that are not completely dried, since a moving direction of the low ignition propensity cigarette paper 19 changes without any contact by air, so that poor moving due to contamination may be prevented. On the contrary, when typical rollers are used, as in moving units of the related art, since the coating composition contains substances with high adhesion such as starch, when the applied coating composition is not completely dried, the coating composition is transferred to the surface of a roller, so that poor moving may be generated and the coated surface may be damaged.

The air may be compressed air. For example, the pressure of the compressed air may be about 3 bars to about 6 bars. The floated height of the low ignition propensity cigarette paper 19 may be appropriately adjusted by controlling the amount of the compressed air. The air may be output substantially perpendicular to the coating portions 18.

The outlets 319 may be disposed on the curved surface of the air moving body portion. The outlets 319 may be fine circular holes formed at several positions, and particularly, the size, shape, and number are not limited.

Referring to FIG. 2, the air moving unit 300 may be implemented in an arc shape with various angles q. An air moving unit 300 having an arc shape with an angle q may be installed in order to turn the low ignition propensity cigarette paper 19 at an angle of p with the air moving unit 300. For example, the angle q may be about (p−10) degrees to about (p+10) degrees and the low ignition propensity cigarette paper 19 having the coating portions 18 may be effectively floated and turned within the range.

Referring to FIG. 3, the air moving unit 300 may be provided with side guiding members to prevent lateral separation of the low ignition propensity cigarette paper.

Referring to FIG. 1 again, the low ignition propensity cigarette paper 19 that has passed the air moving unit 300 passes cooling units 230 and 240. The cooling units 230 and 240 may reduce the temperature of the low ignition propensity cigarette paper 19 which increased by the drying units 210 and 220. For example, the cooling units 230 and 240 may be cooling bars that are supplied with a substance such as cooling water. One or more cooling units 230 and 240 may be used.

The low ignition propensity cigarette paper 19 that have passed the cooling units 230 and 240 passes an air moving unit 400. The air moving unit 400 has an inlet 411, outlets 419, and an air moving body portion 410 and the description of the air moving unit 300 may be applied to the air moving unit 400 in the same way.

The low ignition propensity cigarette paper 19 that has passed the air moving unit 400 may be supplied to a device of producing a cigarette including a low ignition propensity cigarette paper through a roller 940.

A device of manufacturing a low ignition propensity cigarette paper may be implemented in an on-line type by being mounted in a device of producing a cigarette or may be implemented in an off-line type by being mounted outside a device of producing a cigarette.

Referring to FIGS. 4 and 5, a cigarette 1 has a cigarette column portion 10 that is burned and a cigarette filter portion 20 that filters tobacco smoke. The cigarette column portion 10 may be wrapped with the cigarette paper 19 and the cigarette filter portion 20 may be wrapped with a cigarette filter wrapping paper 28. The cigarette column portion 10 and the cigarette filter portion 20 may be connected by the tipping paper 29. The circumference of a cigarette may be about 5 mm to 30 mm. The cigarette filter portion 20 may be omitted.

The cigarette column portion 10 includes cut tobacco leaves 11 cut from a leaf tobacco processed by various methods.

The cigarette filter portion 20 may has a first filter portion 21. The first filter portion 21 may be made of acetate tow or paper. The cigarette filter portion 20 may be a multi-filter including two or more filter members. For example, referring to FIG. 6, the cigarette filter portion 20 may include a first filter portion 20, a second filter portion 22, and a third filter portion 23. Further, the cigarette filter portion 20 may include three filter members or four filter members.

The cigarette filter portion 20 may contain an absorbent and a flavor material. For example, the absorbent may be active carbon and the flavor material may be an herb-smelled material. One or more filter members in a multi-filter may contain at least one of an absorbent or a flavor material. For example, referring to FIG. 6, at least one of the second filter portion 22 and the third filter portion 23 may contain at least one of an absorbent or a flavor material.

The low ignition propensity cigarette paper 19 has one or more coating portions 18. For example, the coating portion 18 may have a band shape, but may have other various shapes. The number, thickness, and shape of the coating portion 18 may be changed in various ways and the gaps between the coating portions 18 may be changed in various ways. The coating portion 18 may reduce porosity of the cigarette paper 19, and accordingly, when combustion of the cigarette reaches the coating portion 18, the amount of oxygen flowing into the cigarette column portion 10 decreases and the cigarette 1 may be put out. The cigarette paper 19 having the coating portions 18 is also called a low ignition propensity cigarette paper. A coating composition is coat at the coating portion 18. For example, the porosity of the cigarette paper 19 may be about 85 cu or less and the porosity of the coating portion 18 may be about 5 cu to about 20 cu. The thickness of the base paper of the cigarette paper may be about 30 μm to about 60 μm and the basis weight of the base paper may be about 15 $g/m^2$ to about 40 $g/m^2$. The thickness of the coating portion 18 may be about 5 μm or less and the basis weight of the coating portion 18 may be about 15 $g/m^2$ or less. The ratio of the weight of the coating composition to the total weight of the cigarette paper 19 and the coating composition may be about 35 wt % or less. When the coating portion 18 has a band shape, the weight of the coating composition per band may be 2.5 mg or less.

The cigarette paper 19 may include filler, and accordingly, opacity of a cigarette paper may increases and porosity may be provided to a cigarette paper, and flatness and ash integrity of a cigarette paper may be improved and whiteness of a cigarette paper may increase. For example, the filler may be calcium carbonate, titanium dioxide, or magnesium oxide. The filler may be used by about 20 wt % to about 40 wt % to the entire weight of the cigarette paper.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A device for manufacturing and moving a low ignition propensity cigarette paper, comprising:

a coating unit configured to coat a cigarette paper with coating composition to form the low ignition propensity cigarette paper having a plurality of coating portions, wherein a gap exists between a first one of the plurality of coating portions and a second one of the plurality of coating portions;

a drying unit configured to dry the low ignition propensity cigarette paper;

an air moving unit configured to float and turn the low ignition propensity cigarette paper by air; and a cooling unit configured to cool the low ignition propensity cigarette paper, wherein the air moving unit comprises:

an air moving body portion having a curved surface, an inlet configured to inject air; and a plurality of outlets disposed at the curved surface to discharge the air, wherein the plurality of outlets face the plurality of coating portions, wherein the plurality of outlets are separated from the plurality of coating portions, and wherein a curvature of the curved surface conforms to a curvature of the low ignition propensity cigarette paper which is turned.

2. The device of claim 1, wherein the air moving unit further includes a side guide member configured to guide a side of the low ignition propensity cigarette paper.

3. The device of claim 2, wherein the air moving unit forms an arc shape having an angle of q degrees to provide a turning angle of p degrees to the low ignition propensity cigarette paper, wherein q is within ten degrees of p.

4. The device of claim 1, wherein all of the plurality of outlets disposed on the curved surface are configured to discharge the air, toward the low ignition propensity cigarette paper, at a direction that is perpendicular to a surface of the low ignition propensity cigarette paper.

* * * * *